US008439585B2

(12) United States Patent
Silva Rubio et al.

(10) Patent No.: US 8,439,585 B2
(45) Date of Patent: May 14, 2013

(54) ERASER AND MARKER HOLDER FOR WHITE BOARDS

(76) Inventors: Miguel Angel Silva Rubio, Naucalpan (MX); Mauricio Enrique Ferrusca Ceja, Mexico City (MX)

( * ) Notice: Subject to any disclaimer, the term of this patent is extended or adjusted under 35 U.S.C. 154(b) by 662 days.

(21) Appl. No.: 12/499,258

(22) Filed: Jul. 8, 2009

(65) Prior Publication Data

US 2010/0172687 A1 Jul. 8, 2010

(30) Foreign Application Priority Data

Sep. 25, 2008 (MX) ..... MX/u/2008/000311 U

(51) Int. Cl.
*B43K 23/00* (2006.01)
*B43K 23/06* (2006.01)

(52) U.S. Cl.
USPC ..... 401/131; 206/214

(58) Field of Classification Search ..... 401/131; 211/69.1, 69.9; D19/53, 85; D8/71, 373; 206/214, 371; 224/0.5; 434/417
See application file for complete search history.

(56) References Cited

U.S. PATENT DOCUMENTS

| | | | | | |
|---|---|---|---|---|---|
| 67,120 | A * | 7/1867 | Jedamski | 211/69.8 |
| 3,110,917 | A * | 11/1963 | McPeek, Jr. | 206/443 |
| D265,287 | S * | 7/1982 | Ziaylek, Jr. | D8/373 |
| 4,850,484 | A * | 7/1989 | Denman | 206/366 |
| 4,875,591 | A * | 10/1989 | Mikesell | 211/69.1 |
| 5,072,483 | A * | 12/1991 | Durand | 401/131 |
| 5,232,103 | A * | 8/1993 | Koenig et al. | 211/69.5 |
| 5,880,713 | A * | 3/1999 | Belardinelli | 211/69.1 |
| D432,903 | S * | 10/2000 | Cohen et al. | D8/373 |
| 6,202,862 | B1 * | 3/2001 | Acquaviva et al. | 211/69.5 |
| 6,283,279 | B1 * | 9/2001 | Harrington | 206/214 |
| 6,305,864 | B1 * | 10/2001 | Nguyen | 401/131 |
| D487,170 | S * | 2/2004 | Petruccelli | D28/73 |
| D496,068 | S * | 9/2004 | Mandel | D19/36 |
| 6,793,430 | B1 * | 9/2004 | Liu | 401/131 |
| D535,821 | S * | 1/2007 | Chen et al. | D3/304 |
| 7,234,601 | B2 * | 6/2007 | Aspden | 211/10 |
| 7,740,133 | B2 * | 6/2010 | Lamas | 206/214 |
| 7,993,142 | B2 * | 8/2011 | Kang et al. | 434/429 |
| 2002/0146272 | A1 * | 10/2002 | Conover | 401/131 |
| 2007/0071536 | A1 * | 3/2007 | Rhodes | 401/195 |
| 2008/0056805 | A1 * | 3/2008 | Hawkins | 401/131 |
| 2008/0166173 | A1 * | 7/2008 | Gibbons | 401/131 |
| 2010/0288655 | A1 * | 11/2010 | Silva Rubio et al. | 206/214 |
| 2011/0086335 | A1 * | 4/2011 | Rogers | 401/131 |

* cited by examiner

*Primary Examiner* — David Walczak
*Assistant Examiner* — Bradley Oliver
(74) *Attorney, Agent, or Firm* — FisherBroyles, LLP

(57) ABSTRACT

The present invention refers to an article to be used to hold and carry writing instruments, such as an eraser and a markers for a white board; the article includes means to support the article in a removable way on a flat surface, such as a wall, a blackboard, a table or a similar surface, so that both the eraser and the markers can be easily located by the user during a working session. In the embodiment illustrated, the article has the capacity to hold one eraser and up to three conventional markers.

3 Claims, 7 Drawing Sheets

ERASER AND MARKER HOLDER FOR WHITE BOARDS

CLAIM OF PRIORITY

This application claims priority from Mexican patent application MX/u/2008/000311, "Eraser And Marker Holder For White Boards," filed Sep. 25, 2008.

TECHNICAL FIELD

The present invention is related with writing instruments, such as those used for white boards that require special markers as well as special erasers; especially the present invention is directed to an object that allows for the storage and transportation of an eraser and various markers, as well as maintaining them within arm's reach of the user of the board.

BACKGROUND OF THE INVENTION

In recent years, the use of white boards and therefore the use of dry erase markers required for their use have become more popular every day. Many of the markers are designed to be used on relatively non porous surfaces, such as Mylar, plastic film, porcelain, or surfaces similar to that of the porcelain and of other similar surfaces. A common term for these boards and walls with this type of surface is "white board". To write on this white board, various types of markers are used. Typically, the markers for white boards have a special formula that substantially impedes the ink from permanently adhering to the non porous surface being written on. This ink dries on the surface of the white board leaving a thin film. Previously, in order to erase the dry ink of the marker, the materials used in the erasers have been similar to those that were used in the erasers for chalk boards. The dry ink is erased relatively easily with a variety of materials and devices but the most common is to use an eraser with bristles made of many different materials such as felt, cloth or including being able to be erased with the hand of the user.

Traditionally, one of the main problems with the known markers is that the eraser is a piece that is separate from the markers and which results in that the eraser is frequently very hard to find because someone had removed it or that it was misplaced in an inadequate place. In this way, the eraser is not always available to the user to erase the writing surface. In a similar way, the markers can be removed or easily placed in different place within the work zone close to the board, provoking that the users has to move from one side to the other in order to reach desired marker in said moment, especially in order to use many combinations of colors, which is one of the more useful characteristics of the white board.

To solve the problem of the removal and misplacement of the markers and the eraser, many alternatives have been proposed. Such as the U.S. Pat. No. 3,110,917 (McPeek Jr., 1963), which describes an eraser in the form of a prismatic bar with one face containing the erasing element, and the opposite face offering holes designed to hold 3 sticks of chalk, which are maintained in place by a sliding lid that covers them when access is not required; the eraser also includes a magnet that allows for the attachment to a metallic support fixed to the wall.

The U.S. Pat. No. 5,432,973 (Wagner et al, 1995) describes a device a little more practical and appropriate for the instruments used with white boards. It is made up of a system of erasing especially adapted for white boards, that has a first means of erasing, such as a pile of cloths, and as a second means of erasing hard to remove marks, such as Velcro, the eraser also includes a sleeve designed to hold up to three markers.

This sleeve has projections with corners in right angles that form three slots along the length of the eraser where a marker can be placed in one of the slots; it seems that the removal of one of the markers only can be done by taking the ends and placing outward pressure on the slot. The design seems to be uncomfortable for the user, especially because of the presence of the sharp corners, and because there is only one line of support for the sleeve, it seems fragile, requiring the material used in its fabrication to be sufficiently flexible which at the same time produces only a little strength in the eraser.

The design proposed by Krapf (U.S. Pat. No. D398,644, 1998) partially resolves the problem of the sharps corners as was in Wagner's design, and it also allows for the lodging of writing instruments of diverse dimensions, such as markers and skinny markers. Nonetheless, the design still presents the problems of stability associated with only one line of attachment between the body of the eraser and the sleeve of the marker case.

The U.S. Pat. No. 6,305,864 (Nguyen, 2001), not directed at a conjunction of an eraser and markers, offers an interesting solution to the problem of the finding the writing instruments. Upon providing a system based on a suction cup configuration to be pressed against a flat surface, the cup includes a localized connector on the exterior of the convex surface and said connector is joined with a hole especially designed in the base of the writing instrument in a way so that said instrument can be placed on any flat surface with the help of the suction cup. This alternative is fairly practical when it is compared with the differences it has to McPeek's device, such that it doesn't need a metal support fixed to a wall to be able to find the article in question, nonetheless it does have the limitation of not being able to hold more than one article at a time.

Unlike Nguyen's device, Hawkins, U.S. Pat. No. 7,309, 181, proposes an eraser for the white board that has an upper region and a lower region, a layer of eraser material that has an upper section and a lower section, where the upper section is fixed to the lower region of the body of the eraser, and the eraser has at least one hole in the upper region to accommodate at least one unit of writing utensils, and a magnetic element connected in a functional way to the body of the eraser between the upper section of the layer of eraser material and the upper region of the body of the eraser. Nonetheless, even when Hawkins's article can hold more than one writing utensil and has the possibilities to be attached to a magnetic surface, like the majority of the boards, the design is such that when the writing utensils are found to be in their positions over the body of the eraser, they disturb the user.

OBJECTS OF THE INVENTION

In view of the limitations that the proposed developments have presented up until now as explained in the previous part, the present invention has as its objective to provide an article that simultaneously holds an eraser and various markers special for use on white boards.

Another objective of the present invention is to provide an eraser and marker holder that allows easy access to, and easy release of the eraser and one or more of the markers on its interior.

Still another objective of the invention is to provide an eraser and marker holder that is easily positionable close to the white board in use.

One more objective of the invention is to provide an eraser and marker holder that is easily attachable, and easy to remove, with close proximity to the board in use.

These and other objectives and advantages of the present invention will be made evident in the following description, which is accompanied by a series of figures for the preferred embodiments of the invention, that should be understood with the purpose of being illustrative and are not to be limiting to the teachings of the invention.

BRIEF DESCRIPTION OF THE INVENTION

The present invention is related to a useful article for the storage and the transportation of an eraser and various markers for white board, and that furthermore, has means to be able to be hung in a removable way in proximity to the board in use, such as the user can quickly and easily access the writing instruments and eraser, and remove the object when it is no longer necessary for the instruments to be in use.

The article of the invention includes means of attachment for an eraser in a rectangular section, which will hold the eraser against the base of the article by sustaining it in three points along its edges. Two of these points are situated along one edge of the eraser and the third is located in the middle of the opposite side. It is easy to free from the means of attachment by placing pressure on the release button.

Additionally, the device of the invention offers three approximately semicircular slots with means of attachment on both opposite side for the internal face of each slot to retain other markers for the white board. They will be able to be easily released by twisting the group of slots in such a way that the opposite sides of the internal face of the slot in question opens enough so that the means of attachment allows the release of the body of the marker. These three slots are located on a side of the section of the eraser holder in a way that one of the extremes of the group of slots is located in the middle of the two points of attachment of the eraser previously described, extending the group in the opposite direction from the location of the third point of attachment of the eraser.

The device has an opening located in the base of the eraser holder with dimensions such that it allows the passage and the holding in place of the means of support of the device in order to hang in on a flat surface. The preferred means of support are of the type of a suction cup that allows it to be applied on any type of surface that is sufficiently smooth, such as a wall, the white board itself or a table with the purpose being to hold the object of the invention in a fixed place during the time that the user requires the use of the writing instruments and the eraser, and then, the removal of the object of the invention for its storage once the use of said instruments is no longer needed.

BRIEF DESCRIPTION OF THE DRAWINGS

For a better understanding of the advantages of the system of the invention, a series of drawings and figures are presented. They illustratively show the preferred characteristics of the system, without being limiting of the same.

DESCRIPTION OF THE INVENTION

The following description will be referring to the accompanying drawings previously described; they should be understood as illustrative of the preferred embodiments of the invention and not limiting to the scope of the inventive concept. The common elements in the figures have the same reference numbers in every figure.

The present invention refers to a device or an article for the storage and transportation of an eraser and various markers, with means of supporting said object on a smooth surface such as a wall, the white board itself, a table or other similar object, in a way such that the eraser as well as the markers are perfectly located for the users during a work session on the white board.

Figure 1:
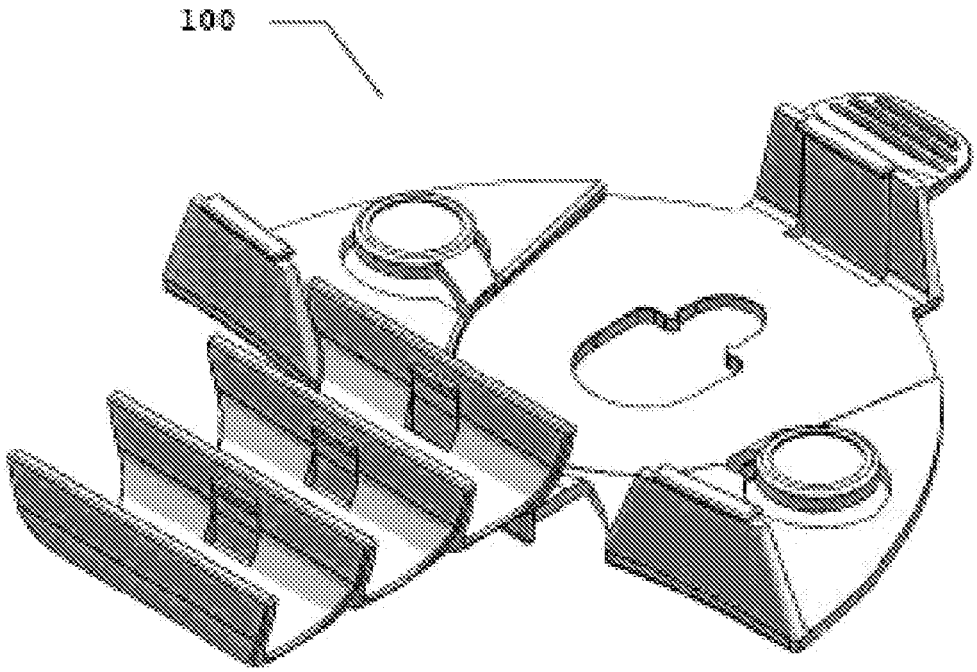
FIG. 1 is a simple perspective view of the eraser and marker holder, object of the invention.
Figure 2:
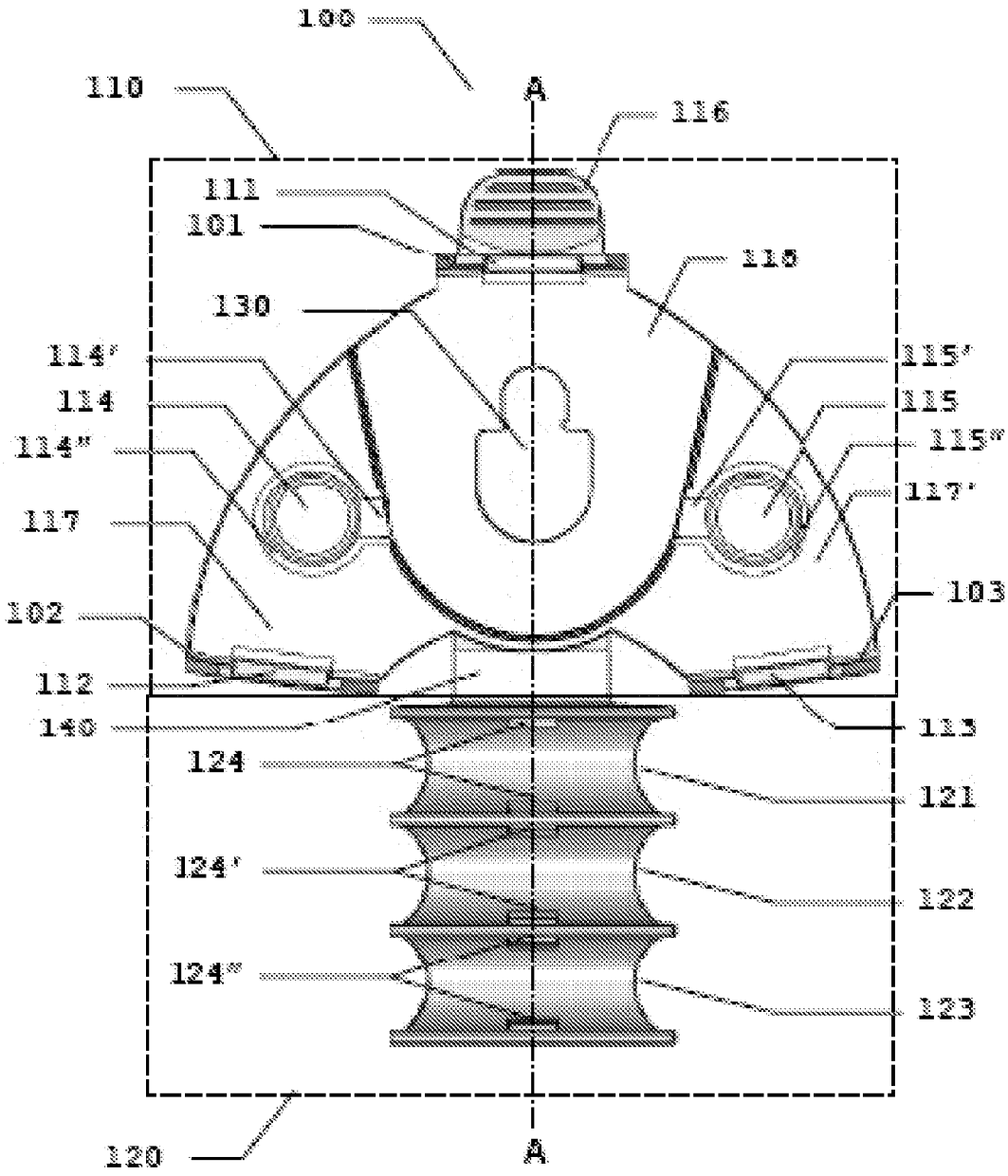
FIG. 2 is a superior view of the eraser and marker holder, object of the invention.
Figure 3:
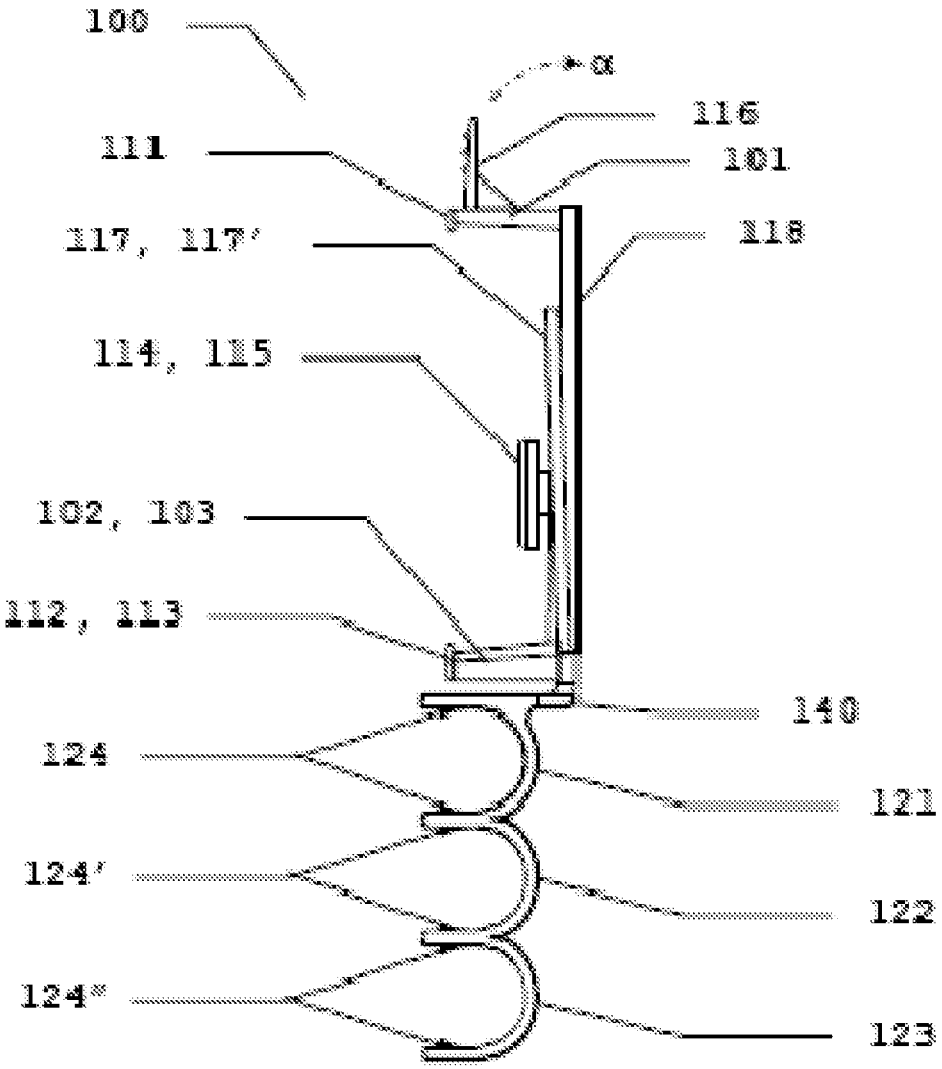
FIG. 3 is a lateral view of the eraser and marker holder, object of the invention.
Figure 4:
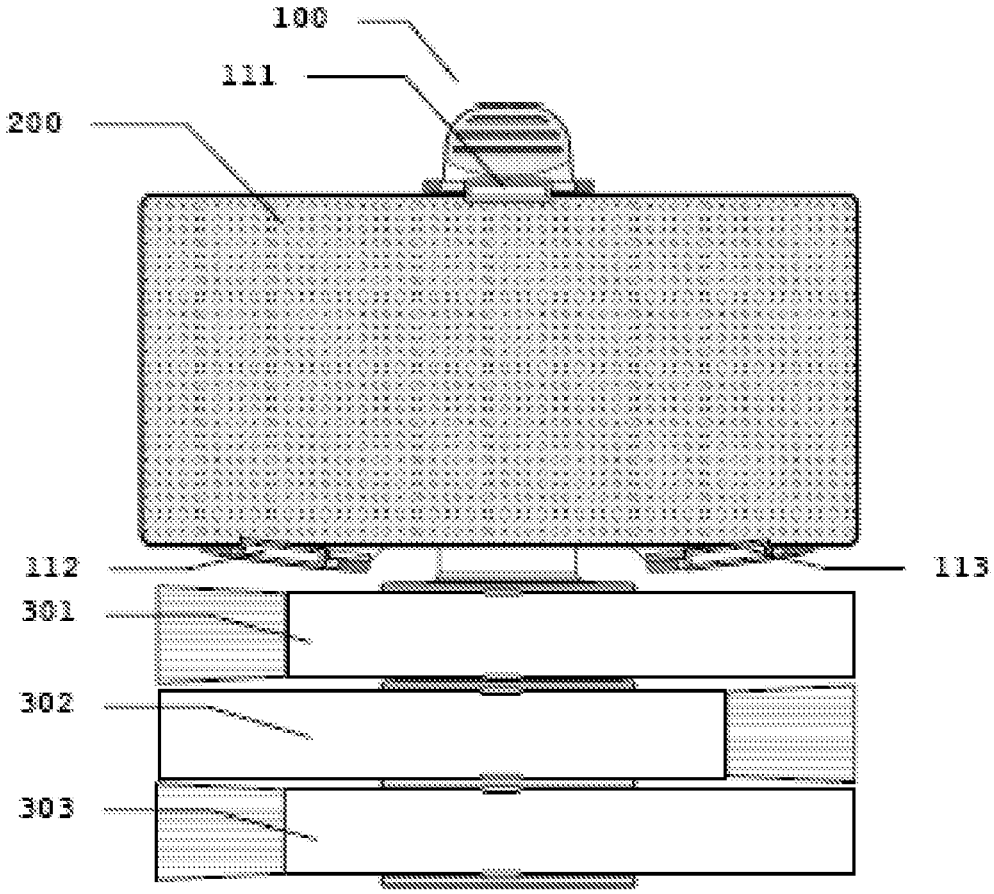
FIG. 4 is a superior view of the eraser and marker holder, object of the invention, with an eraser and three markers in their place of use in the object of the invention.
Figure 5:
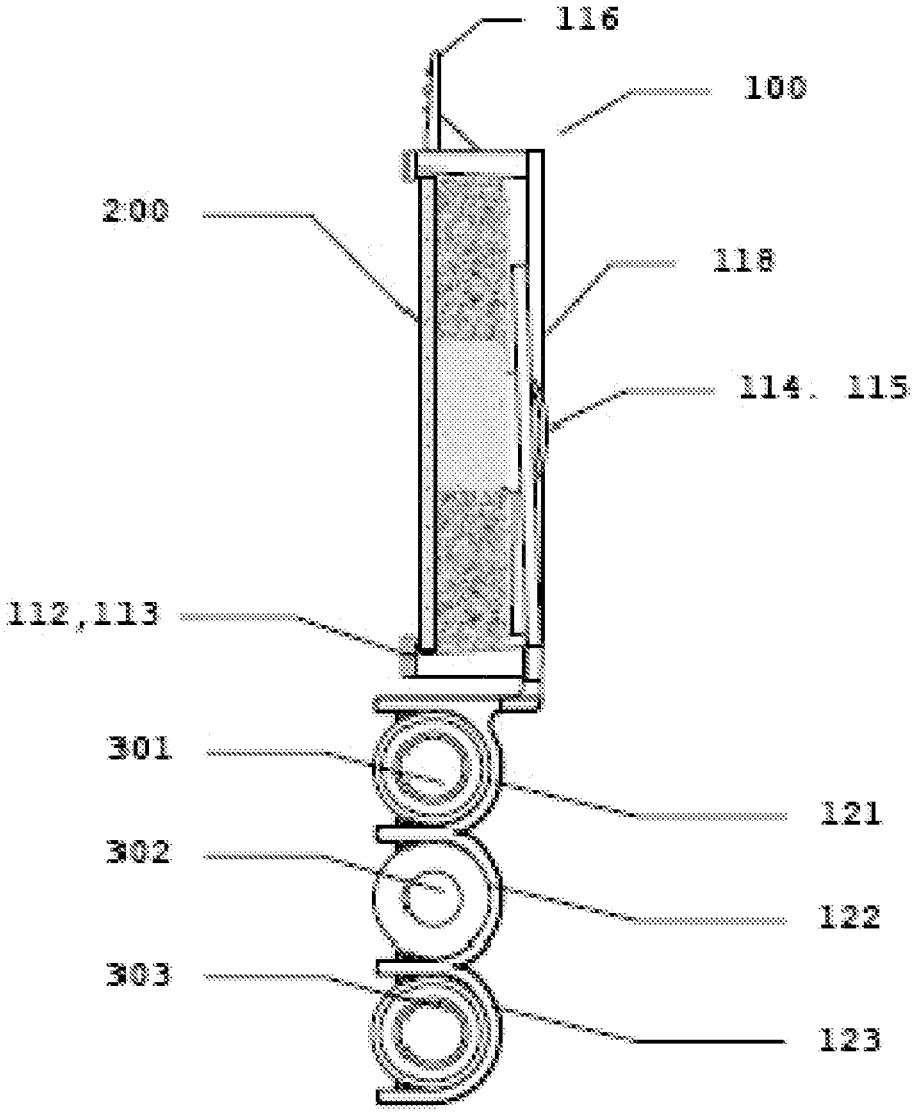
FIG. 5 is a lateral view of the eraser and marker holder, object of the invention, with an eraser and three markers in their place of use in the object of the invention

The device or the article of the invention is referred to in general by the number (100) in FIGS. 1 through 6; the elements of which it is composed appear better in FIGS. 2 and 3, including a first zone (110) of the eraser holder, defined by the upper border, designed to hold a conventional eraser (designated by number (200) in FIGS. 4 and 5, further ahead) for the white board and a second zone (120) for the marker holder, defined by the lower border, designed for holding multiple markers for the board, for example the type known as for the "white board".

The first zone (110), including surfaces (117) and (117') that serve as a support base for a conventional eraser, defined on the "lower" extreme with respect to the positioning of FIG. 2 of the vertical walls (102) and (103) in a trapezoidal form with the large base formed by the union with the surfaces (117) and (117'), preferably perpendicular to the central axis of A-A symmetry of the object (100) but that also an angle can be presented that allows the means of attachment to the walls of the eraser when it is placed in its position in the object (100) of the invention. If the contour of the surfaces (117) and (117') do not interfere with the functionality of the object (100), it is recommended that these form an arc upon leaving the inferior extreme where the vertical walls (102) and (103) start to elevate to avoid angles that would represent risks to the users' skin or the papers that are in the area. The walls (117) and (117') are limited in the zone oriented toward the center of the object (100) by a symmetrical arc that opens upward forming another surface of the base (118) that offers a slope in the same direction. It slopes in such a way that the upper extreme of the object's (100) surface is found to be out of place in respect to the plane formed by surfaces (117) and (117') in a measurement that permits the body of the means of attachment for the object (100) to rest against it, as will be described shortly; this is evident in FIG. 3 that is a lateral view or a profile view of the object (100).

It can be observed that the contour of the surface (118) is a continuation of the arc defined by the edges of surfaces (117) and (117') closing the arc with a vertical wall (101) just along the vertex from the arc in respect to the vertical walls (102) and (103). The wall (101) is completely perpendicular to the axis of symmetry A-A of the object (100) and in a trapezoidal form with the large base forming a union with the surface (118).

The three vertical walls (101), (102) and (103) present in the small bases, projections (111), (112) and (113) that project out toward the interior of the zone defined by the surfaces (117), (117') and (118). These projections, preferably of a rectangular section, are designed to hold the edges of the body of the eraser that it is going to carry, holding it in three points. The distances between the wall (101) and the walls (102) and (103) should be that of the width of conventional eraser in such a way that the projections (111), (112) and (113) lightly attach over the eraser, as is illustrated in FIGS. 4 and 5.

Contributing to holding the eraser in the zone (110) and to avoid the eraser slipping up or down over the walls, in such a way that the edges can avoid the attachment by the projections (111), (112) and (113') it includes elements of attachment formed by two areas (114) and (115), cut from the lateral surfaces (117) and (117'), attached to the surface (118) by means of two tongues (114') and (115') respectively, that freely move through the openings (114") and (115") that correspond to them, placed in the lateral surfaces (117) and (117') and originally projecting on top of the plane defined by said lateral surfaces (117) and (117') making the functions of the walls that compress the body of the conventional eraser located in the area of the eraser holder (110) of article (100) against the projections (111), (112) and (113), holding it and inhibiting its movement.

To release the eraser, and take advantage of the flexibility that the object (100) has, as for the material of fabrication as well as for the design, there is a button like tongue (116) with a textured surface, that allows the wall (101) to flex and move in the direction indicated by the arrow "a" in FIG. 3, freeing the eraser from the projection (111) upon applying a gentle force on said texturized surface of said bottom like tongue (116); in this way, the eraser, thus liberated on one of its edges, can be removed from the zone (110).

Figure 6:
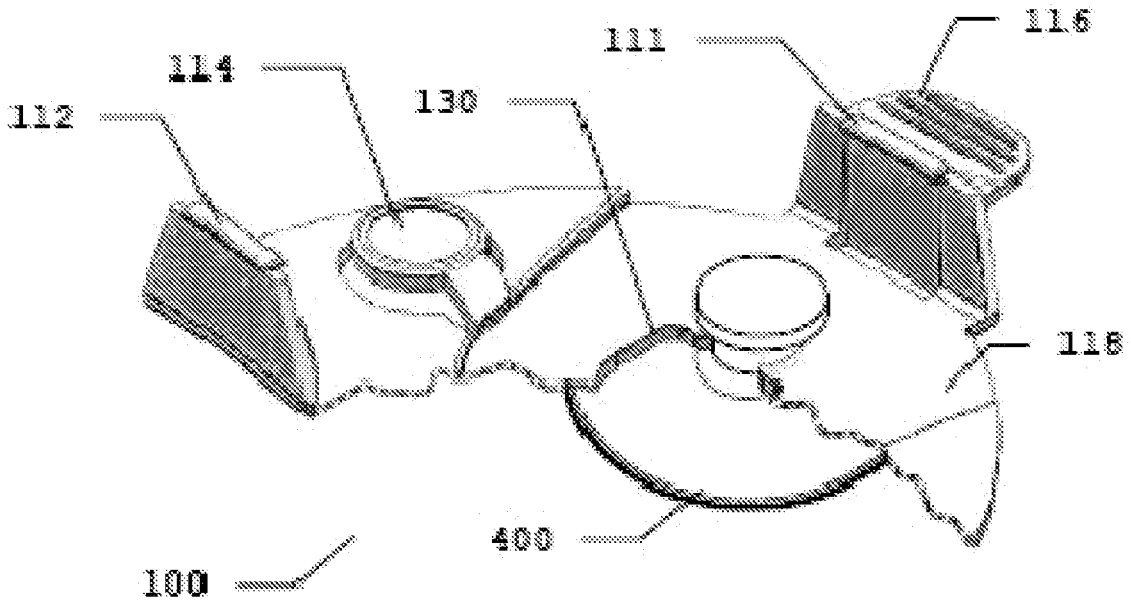
FIG. 6 is a sectional cut of the zone of the eraser holder of the eraser and marker holder, object of the invention, showing the location of the means of attachment and support to fix it to a smooth surface.

The surface (118) also offers a perforation (130) to hold and attach means of support to attach, support, or fix the object temporarily on a smooth surface, such as a wall, the board itself, or a table. The perforation (130) of the surface (118) has a first section located towards the bottom of FIG. 2 with a form and dimensions such that allow the free passage of the support (410) of the means of attachment, such as a suction cup (400); a second section of the perforation (130) located towards the top in FIG. 2, has the dimensions and form such that it can hold the neck (420) of the suction cup (400) and can hold it in place due to the narrowing between said two sections of the perforation (130) formed by the projections. The narrow section only allows the passage of the neck (420) of the suction cup (400) upon exerting a certain amount of strength and the deformation of the material as is schematically illustrated in the cut of FIG. 6.

Figure 7:
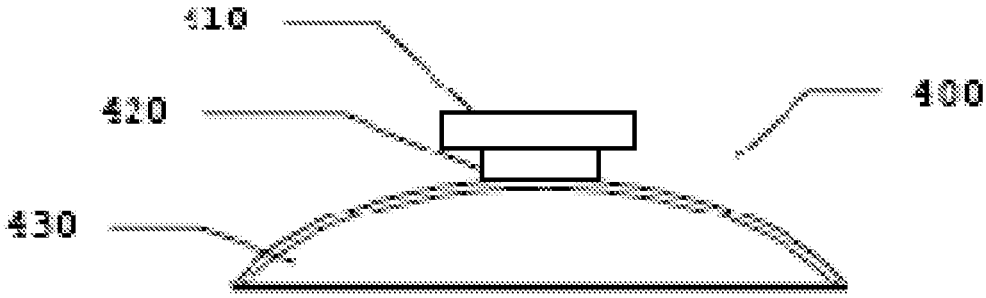
FIG. 7 is a lateral plane view of the preferred means of attachment and support to fix the eraser and marker holder, object of the invention to a smooth surface.
Figure 8:
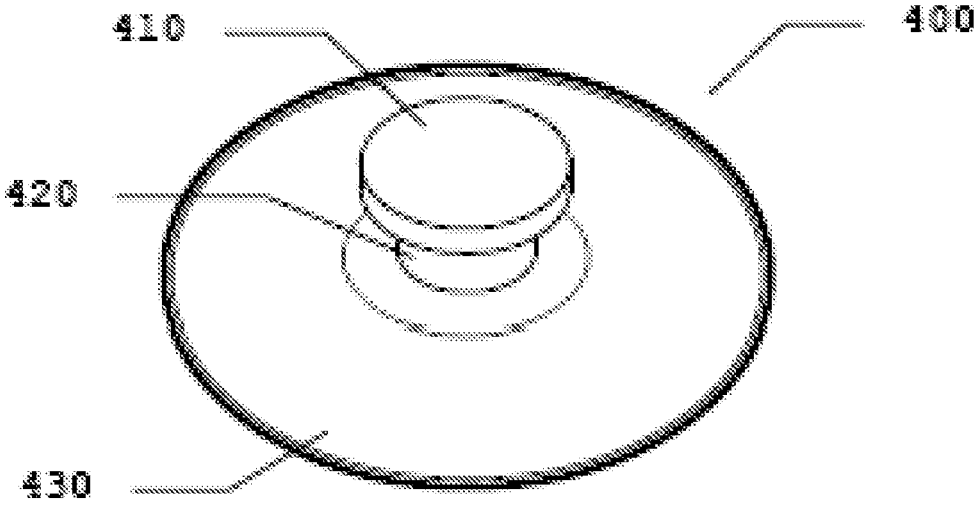
FIG. 8 is a perspective view of the preferred means of attachment and support to fix the eraser and marker holder, object of the invention to a smooth surface.

As was mentioned in the previous paragraph, the preferred embodiment of means of support is by use of a suction cup, as is schematically illustrated in FIGS. 7 and 8 and referred to by the number (400); this conventional suction cup (400) is formed by a body of the cup (430) and a body of attachment (410) joined by a neck (420) all of which is formed all of the same material.

With respect to the marker holding zone (120) in FIG. 2, it is composed of multiple grooves with a transversal section in a form of a "U" denoted by the numbers (121), (122) and (123) as it is clearly shown in FIGS. 2 and 3; said grooves are found to be joined by a common wall between each pair. In the figures, the model of the object (100) of the invention is illustrated with three of these grooves. The grooves (121), (122) and (123) because of the "U" shaped form have lateral walls that have both extremes open; in these walls, there are found pairs of projections (124), (124') and (124") opposite from one another, one pair per groove, and with a profile that defines the continuation of the curved wall of each groove, in a way that perfectly accommodates the cylindrical bodies of many dry erase markers (301), (302) and (303), as is illustrated in FIG. 5. Due to the fact that the markers generally are not perfect cylinders, the insertion of the same in the corresponding grooves (121), (122) and (123) can be slightly difficult to accommodate due to their configuration. For that reason, an alternating arrangement of the orientation of the markers is needed, with the purpose to compensate the deformation as is illustrated in FIG. 4. To release a specific marker, it is enough to pull on its extremes, with a light force so that the body of the marker passes the projections (124) of the respective groove; this is possible thanks to the flexibility of the material as well as the geometry of the group of grooves, that have slight flexibility of the group in order to separate the extremes of the "U" of one or various grooves.

Finally, the zones (110) and (120) are joined by a tongue (140).

Not only does the design of the object of the invention allows it to flex sufficiently to accommodate, hold and free the eraser and the markers, it is also important to point out that the walls are thin, although sufficiently thick enough to avoid the material breaking for fatigue. The material itself is preferably rigid but with a certain amount of flexibility.

Considering the previous description, it would be evident for a person with knowledge in the field that some modification to the basic configuration of the article illustrated could be necessary to satisfy specific requirements, but it should be taken into consideration that these modifications will not take the invention farther than described in the following claims. It is also clear the reference to the white boards and associated markers, should not be limiting, and anytime that there are other devices for writing, that include the electronic boards, panels of plastic or crystal, touch screens, etc. that use similar instruments to said markers and erasers, for that which the device of the invention can be used, with little or no additional adaption to the general configuration.

What is claimed is:

1. An eraser and marker holder which includes a first erase holder area and a second markers holder area with a plurality of channels and corresponding means to hold the markers; a first tongue joins the first area with the second one; wherein:

a) the first area is composed of two side surfaces that form a single plane and a flat central surface between the two side surfaces, the first area having a semicircle outline;

b) said central surface is tilted with respect to the two side surfaces and have a central hole to accommodate a suction cup to removably fix the eraser and marker holder to a surface; the central surface having at its apex a perpendicular trapezoidal vertical wall with the major base attached to the central surface and the minor base directed upwards, that includes a rectangular projection to retain the body of an eraser directed towards the base of the semicircle, said perpendicular trapezoidal vertical wall allows the application of force by the user on a second tongue protruding at the minor base, opposite to said rectangular projection, to bend the vertical wall to release the eraser originally retained;

c) each of the two side surfaces includes a vertical wall of trapezoidal shape, located close to the union between the first and second areas, with the major base attached to the respective side surface and the minor base directed upwards, said minor base has a rectangular projection directed in opposition to that of the wall of the apex and so offering, with the wall at the apex, three points of support for the retention of an eraser when it is entered in the area defined by the flat surfaces and vertical walls;

d) each of the two side surfaces includes a button, protruding from the surface and acting as a spring, to press an eraser against the rectangular projections of said three vertical walls in order to hold the eraser in the first eraser holder area;

e) the second markers holder area comprises a plurality of parallel U-shaped channels that come together in pairs that share a wall of the "U" and having each of these channels in the area close to the top of the "U", inward projections that allow the passage of the cylindrical body of a marker for its retention or release when the second area is bent.

2. An eraser and marker holder according to claim 1, wherein the button cut out on each of the side surfaces of the first eraser holder area are made by small round cut out areas of said side surfaces and attached to the central surface by a tab which allows movement through the cut out hole to act as a spring; said cut out areas are projected above the plane defined by said side surfaces and exert pressure on the body of an eraser that is inserted in the first eraser holder area, against the rectangular projections on the vertical walls, to offer a better grip of the body of the eraser.

3. The eraser and marker holder according to claim 1, wherein the hole in the central area is comprised of a first and second round holes that are joined together having a narrowing between said round holes, the first round hole allows the passage of the fastening element of a suction cup to attach the eraser and marker holder to a surface and the second round hole, which second round hole supports and secures a thickness reduced area of the suction cup once it passes through the narrowing; the hole as a whole is symmetrical.

* * * * *